United States Patent [19]

Lin

[11] 4,316,716

[45] Feb. 23, 1982

[54] APPARATUS FOR PRODUCING LARGE DIAMETER SPUN FILAMENTS

[75] Inventor: Leroy C. Lin, Richmond, Va.

[73] Assignee: The Goodyear Tire & Rubber Company, Akron, Ohio

[21] Appl. No.: 714,866

[22] Filed: Aug. 16, 1976

[51] Int. Cl.[3] ..... B29C 23/00

[52] U.S. Cl. ..... 425/72 S; 264/24; 425/174.8 E

[58] Field of Search ..... 165/2, 1; 264/22, 24, 264/176 F; 425/72 S, 378 S, 379 S, 463, 464, 382.2, 174.8 E; 226/94; 219/10.81; 198/691

[56] References Cited

U.S. PATENT DOCUMENTS

| | | | |
|---|---|---|---|
| 2,252,684 | 8/1941 | Babcock | 425/72 S |
| 2,336,745 | 12/1943 | Manning | 425/174.8 E X |
| 3,224,497 | 12/1965 | Blomgren, Sr. et al. | 165/2 |
| 3,387,326 | 6/1968 | Hollberg et al. | 425/174.8 E X |
| 3,707,593 | 12/1972 | Fukada et al. | 425/72 S X |
| 3,952,846 | 4/1976 | Han | 165/1 X |

FOREIGN PATENT DOCUMENTS 544904 8/1957 Canada .

OTHER PUBLICATIONS

Electrostatic Cooling-Still Emerging Technology *Design Report*, 3-8-76, pp. 21-24.

"Instant Cooling by Electrostatics", Business Week, 8-12-72, 2 pages.

*Primary Examiner*—Mark Rosenbaum

*Attorney, Agent, or Firm*—D. M. Ronyak

[57] ABSTRACT

Large diameter filaments are produced by increasing the cooling efficiency of a molten polymer as it exits a spinnerette orifice. The cooling is accomplished in a collar configuration having means for directing cooling air and an ionic discharge in a direction transverse to the axis of the filament as it passes through the collar.

4 Claims, 3 Drawing Figures

Figure 3:
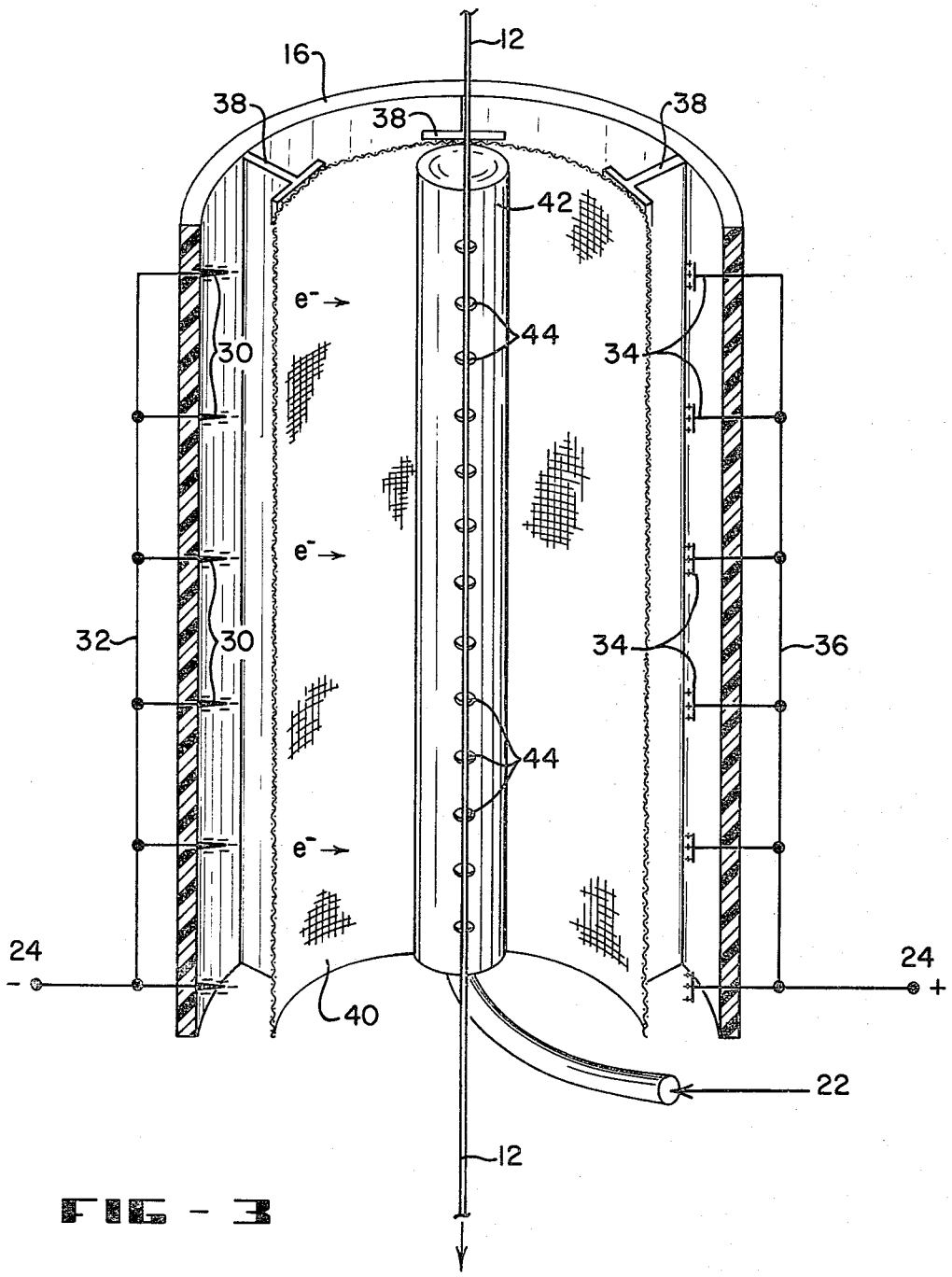

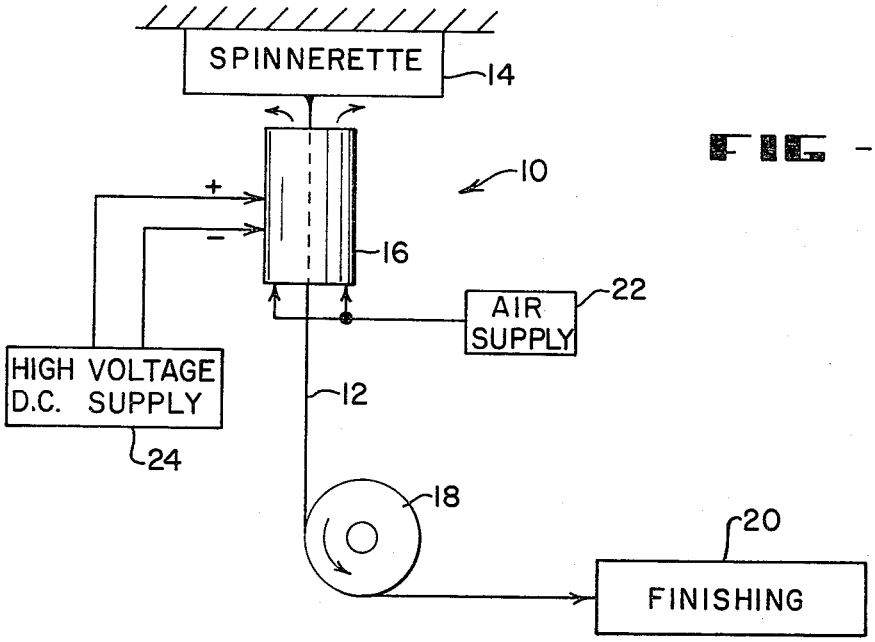
FIG - 1
FIG - 2
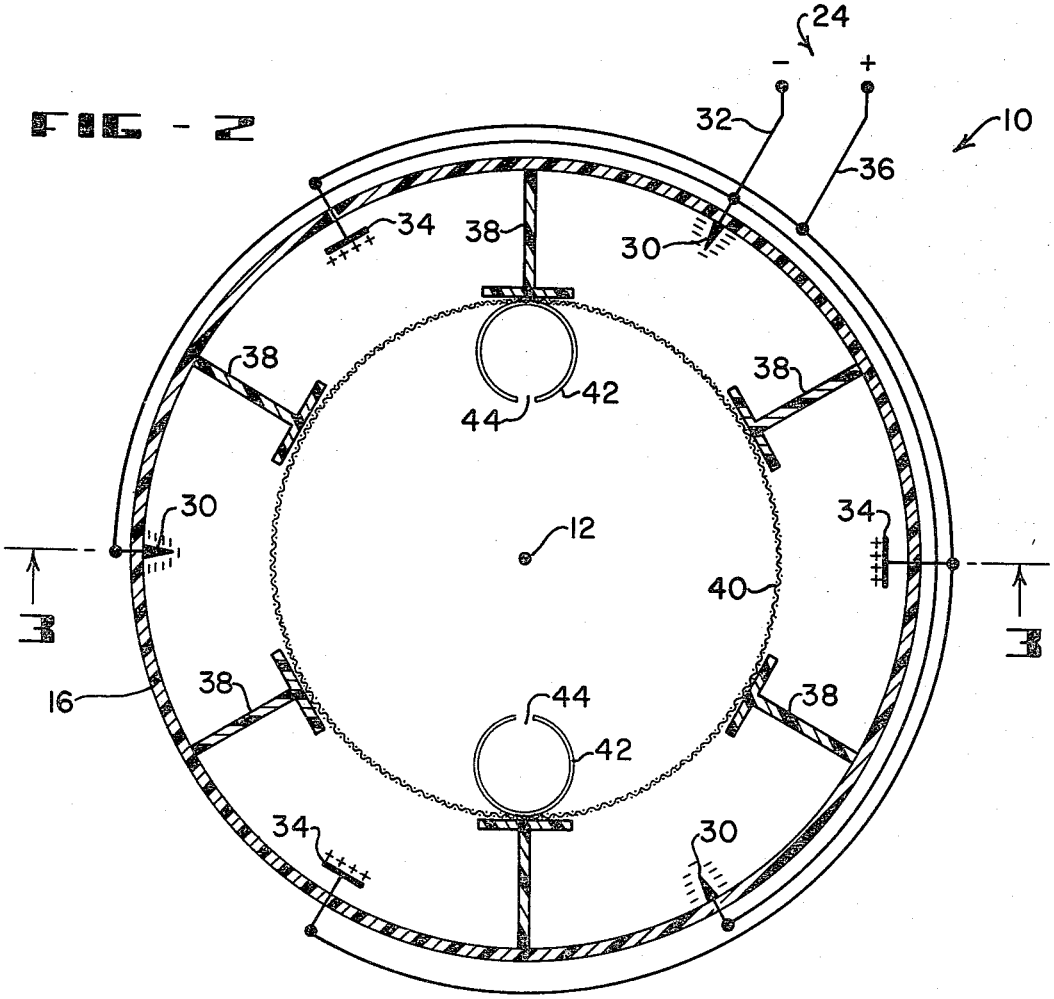

APPARATUS FOR PRODUCING LARGE DIAMETER SPUN FILAMENTS

BACKGROUND OF THE INVENTION

This invention generally relates to fiber production and more particularly to apparatus for producing large diameter spun filaments.

In the manufacture of synthetic fiber filaments, it is generally recognized that filament size is a function of a "drawing" operation wherein a continuous spun strand is submitted to a battery of equipment especially designed to "finish" the filament according to a predetermined specification. The filaments may therefore be spun and spooled for future drawing or may be spun-drawn to effect particular characteristics to the filamentary material. The "drawing" operation is known and understood by persons knowledgeable in the art and is therefore considered beyond the scope of the instant invention.

Prior to drawing, the molten polymer is conventionally "pumped" through an orifice at a substantially constant pressure in a vertically oriented spinnerette and air-quenched in a vertical cooling unit or water-quenched in a horizontal water bath. For spun filaments of the larger sizes (5—30 mil) threadline stability is insufficient for vertical air-cooling inasmuch as "necking down" of the molten polymer occurs at the orifice exit. This natural drawing or necking down of the polymer is difficult to control and therefore it is not the practice to air-quench filaments of this larger size. In this circumstance, water-quenching becomes necessary but the throughput for this cooling process is low, thus increasing the expense of producing the larger sizes.

Filaments having drawn or "finished" diameters in excess of 3-mils have become attractive for various applications and it is desirable, therefore, to produce them economically. Inasmuch as liquid cooling decreases production throughput, it would seem ideal if larger size filaments could be air-cooled since high threadline speeds could be achieved. In conventional cross flow air-cooling processes, multi-filament spinning has a tendancy to fuse filaments while mono-filament spinning lacks threadline stability. Thus, problems exist in the state of the art where larger sizes are being considered.

The present invention applies a technique of electrostatic cooling that is described in the publication "Electronic Design", volume 19, No. 20, of Sept. 20, 1971, entitled "High Voltage Ionic Discharges Provide Silent Efficient Cooling". According to this technique, a high voltage ionic discharge cools a hot surface by producing a turbulence that disturbs the thin boundary layer of air molecules on the surface. These air molecules act as an insulating barrier against further cooling of the surface and thus decrease cooling efficiency.

In this respect, therefore, the present invention comprises apparatus for bombarding a molten polymer filament with accelerated electrons in the presence of forced air-cooling to substantially increase the rate of cooling and allow for the formation of larger filament diameters in the spinning process. More specifically, the invention comprises a collar configuration that is mounted proximate to a conventional extruder spinnerette orifice to effect electrostatic cooling of the molten filament as it exits from the spinnerette.

The features and advantages of the invention will become apparent from the following detailed description when considered in conjunction with the accompanyind drawings in which like parts bear like reference numerals.

In the Drawings:

FIG. 1 diagrammatically illustrates the application of the invention to polymer filament spinning;

FIG. 2 is an enlarged plan view, in section, of the electrostatic collar forming an essential part of the invention; and FIG. 3 is a sectional perspective view of the collar taken on line 3—3 of FIG. 2.

DESCRIPTION OF THE INVENTION

Referring to FIG. 1, the method of the invention is shown utilizing apparatus generally indicated by reference numeral 10 for cooling a molten polymer filament 12 as it exits an extruder spinnerette 14. The molten polymer passes through a cooling unit 16 which will be described in detail hereinafter with respect to FIGS. 2 and 3. A roller 18 picks up the filament whereupon it is fed to further processing equipment 20 which may/may not include finish drawing. An air supply 22 is connected into unit 16 to provide air quenching of the molten polymer as it passes down through the unit, and to increase the efficiency of the air-cooling, a high voltage, low amperage d.c. supply 24 is connected to electrode terminals in the unit.

With reference now to FIG. 2, the cooling unit 16 is shown in a sectional plan view looking down through the top with the polymer filament 12 assumed to be entering the page. As illustrated, unit 16 is essentially a cylinder or collar of a non-conductive plastic material. Mounted within the collar are at least three vertical rows of cathode electrodes 30, that are connected via line 32 to the negative terminal of the high voltage power supply 24. Opposite each vertical row of cathodes 30 is a vertical row of anode electrodes 34 connected via line 36 to the positive terminal of the power supply 24. FIG. 3 more clearly illustrates the row arrangement of the electrodes 30 and 34. To provide separation and prevent arcing between adjacent electrodes a plurality of T-section insulators 38 are mounted within the collar 16. The insulators support a screen 40 at the cross bar of the T-section, which screen is in coaxial alignment with the collar 16 and prevents any filament contact with the electrodes. Also mounted to opposite insulators are at least two non-conductive plastic tubes 42 that are closed at the top of the collar and connected at the bottom to the air supply 22. A plurality of vertically spaced orifices 44 are located in each air supply tube such that cooling air is directed to the axis of the collar for quenching filament 12.

In applying the electrostatic collar 16 to the production of polymer filaments, the following should be considered.

(1) The force, whether electrostatic or air, must be balanced or the resultant force kept to a minimum such that the filament or filament group will not be pushed to one side.

(2) Since the polymer is a poor conductor, static charges will build up surrounding the filament. This charge, if not evenly distributed, will eventually push the filament to the cathode or anode electrodes.

(3) When spinning multiple filament yarns, charge may accumulate on the individual filaments with the resultant tendency to repel each other and make spinning very difficult.

(4) The electron flux within the collar must be optimized to avoid ionization of the air and shortcircuiting of the electron flow.

In consideration of the above, an electrostatic collar configuration as illustrated in the drawing and having a 35 kv potential across it in the presence of air-cooling was successful in producing a filament having a 13.5 mil diameter. This filament was subsequently drawn to a "finished" filament exhibiting the following properties:

Diameter: 6 mil
Denier: 225
Tensile Strength: 3.54 lbs.
Tenacity: 7.17 g/d
Elongation to Break: 14.5%

While certain representative embodiments and details have been shown for the purpose of illustrating the invention, it will be apparent to those skilled in the art that various changes and modifications may be made therein without departing from the spirit or scope of the invention.

What is claimed is:

1. In combination with an extruder spinnerette having an orifice from which a molten polymer filament is ejected, apparatus for cooling the molten filament as it exits the spinnerette orifice comprising:

(A) a cold air supply;

(B) a high-voltage, low-amperage D.C. power supply; and (C) electrostatic cooling means comprising a nonconductive collar mounted proximate and axially oriented to the orifice such that the molten polymer filament passes axially therethrough, said collar having means connected to the cold air supply for receiving cooling air within the collar and directing said cooling air transversely to the direction of filament passage, said collar having cathode and anode electrode pairs arranged radially symmetrically around the filament with the cathode and anode of each pair of being diametrically opposed, said electrodes connected to the power supply to effect increased air cooling efficiency of the filament by providing a balanced ionic discharge in the presence of the cooling air.

2. Apparatus as set forth in claim 1 wherein said cathode and anode electrodes are serially connected in balanced, opposing, vertically oriented rows within the collar while said means connected to the air supply comprises an even numbered plurality of opposing vertically extending air tubes each having multiple vertically spaced orifices for directing the air transversely to the axis of the collar.

3. Apparatus as set forth in claim 2 wherein dividers of insulative material are disposed between adjacent rows of electrodes to prohibit shortcircuiting between electrodes.

4. Apparatus as set forth in claim 3 wherein a D.C. potential of at least 25 k volts is applied between cathode and anode electrodes.

* * * * *